US005615882A

United States Patent [19]

Zlotsky

[11] Patent Number: 5,615,882

[45] Date of Patent: Apr. 1, 1997

[54] MAZE GAME WITH MULTIPLE PIECES

[76] Inventor: Dmitry Zlotsky, 59 W. Cedar St., Livingston, N.J. 07039

[21] Appl. No.: 559,762

[22] Filed: Nov. 13, 1995

[51] Int. Cl.[6] ..... A63F 9/08

[52] U.S. Cl. ..... 273/153 S; 273/153 R

[58] Field of Search ..... 273/153 R, 155, 273/156, 153 S

[56] References Cited

U.S. PATENT DOCUMENTS

| | | | |
|---|---|---|---|
| 3,819,187 | 6/1974 | Downs | 273/156 |
| 4,333,652 | 6/1982 | Clancy | 273/153 S |
| 4,412,681 | 11/1983 | Irwin | 273/153 S |
| 4,811,948 | 3/1989 | Gutierrez | 273/156 |

*Primary Examiner*—Steven B. Wong

[57] ABSTRACT

A maze game comprising a plurality of movable maze pieces, a maze board, a housing, having a polygonal shape and containing said maze board, and a top, having slots, restricting maze pieces movements. The maze pieces of substantially elongated shape, arc located in the top's slots, extending both inside the housing, being received by the maze board's passages, and outside to be controlled by the maze handler. When moved in the direction allowed by the slot where it is contained, the maze piece either move along the passage of the maze board, or, if the direction of the slot doesn't coincide with the passage, move the maze board, if other maze pieces allow such a movement. The object of the maze is to place the maze pieces from one predetermined position to another. There is further provided a 3D version of the maze game, comprising a maze body, sides of which are 2D mazes, located inside a transparent body, sides of which include cut through slots, housing elongated maze pieces, controlling movements of the inner maze body.

15 Claims, 6 Drawing Sheets

MAZE GAME WITH MULTIPLE PIECES

BACKGROUND OF THE INVENTION

This invention relates to mazes, and, more particularly, to mazes, employing more than one moving pieces. The mazes, or labyrinths are known to provide a plurality of paths, where a handler of the maze has to find a path from a starting point to the destination using a ball, a pencil to track the way, when the maze is drawn on a piece of paper, or other maze piece. It is one of the objects of the present invention to provide a maze employing more than one playing pieces and where the object is not to reach a predetermined destination of the playing piece on the maze board, but to achieve a predetermined relative orientation of playing pieces.

SUMMARY OF THE INVENTION

The invention provides a maze game comprising at least two movable maze pieces, a maze board, a housing, having a polygonal shape and containing said maze board, and a top, having slots, restricting maze pieces movements. The maze board includes a convex/concave pattern in the shape of grooves or passages of substantially identical width, dimensioned to receive said maze pieces. The maze board is located inside the housing, dimensioned to allow said maze board movement within the housing. The top covers the housing, preventing said maze board to be removed from the housing. The maze pieces, having substantially elongated shape, are located in said top's slots, extending both inside the housing, being received by the maze board's grooves, and outside to be controlled by the maze handler. When moved in the direction allowed by the slot where it is contained, the maze piece may either move along the groove of the maze board, or, if the direction of the slot doesn't coincide with the groove, move the maze board, if other maze pieces allow such a movement. Initially, all the maze pieces hold position in the slots, hereinafter referred to as a start position. The object of the maze is to place said maze pieces into a predetermined position, hereinafter referred to as a finish position. Another object of the maze game is to achieve a predetermined relative orientation of maze pieces. Yet another object of the maze game is to move the maze board from one predetermined position to another, by manipulating maze pieces.

Another aspect of the present invention provides a maze game, further comprising a cover at the side of the housing, opposite to the top, hereinafter referred to as a bottom. Said bottom contains slots, housing movable maze pieces in the same way as does the top, allowing to control maze board movement by manipulation of game pieces, extending both from the top and the bottom of the maze game.

Another aspect of the present invention, provides a maze game, comprising a transparent cube, some or all sides of said cube containing slots, wherein each slot houses an elongated maze piece. The maze game further comprises a cube, located within the transparent cube, each side of said smaller cube containing passages, dimensioned to receive said maze pieces therethrough. Internal ends of the maze pieces are at all times received by the side passages of the internal maze cube. This aspect of the maze game provides a three dimensional version of the substantially two dimensional maze game, described above. The object of the maze game is to move the maze pieces from start to finish position, or to move the internal maze cube from one predetermined position to another, by manipulating maze pieces.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms may be embodied in practice.

BRIEF DESCRIPTION OF THE DRAWINGS

The features of the present invention that are believed to be novel are set forth with particularity in the appended claims. The invention, together with the further objects and advantages thereof, may best be understood by reference to the following description taken in conjunction with the accompanying drawings, wherein like reference numerals identify like elements, and wherein:

DESCRIPTION OF THE PREFERRED EMBODIMENTS

Figure 1:
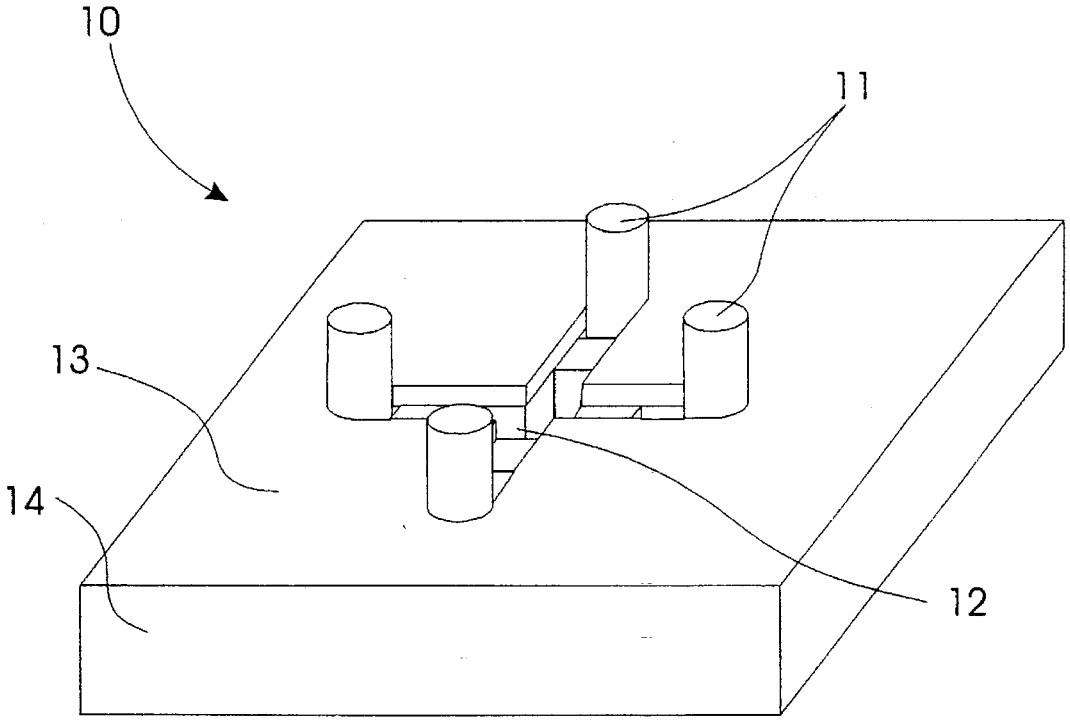
FIG. 1 shows an isometric view of a maze game constructed in accordance with various aspects of the invention.
Figure 2:
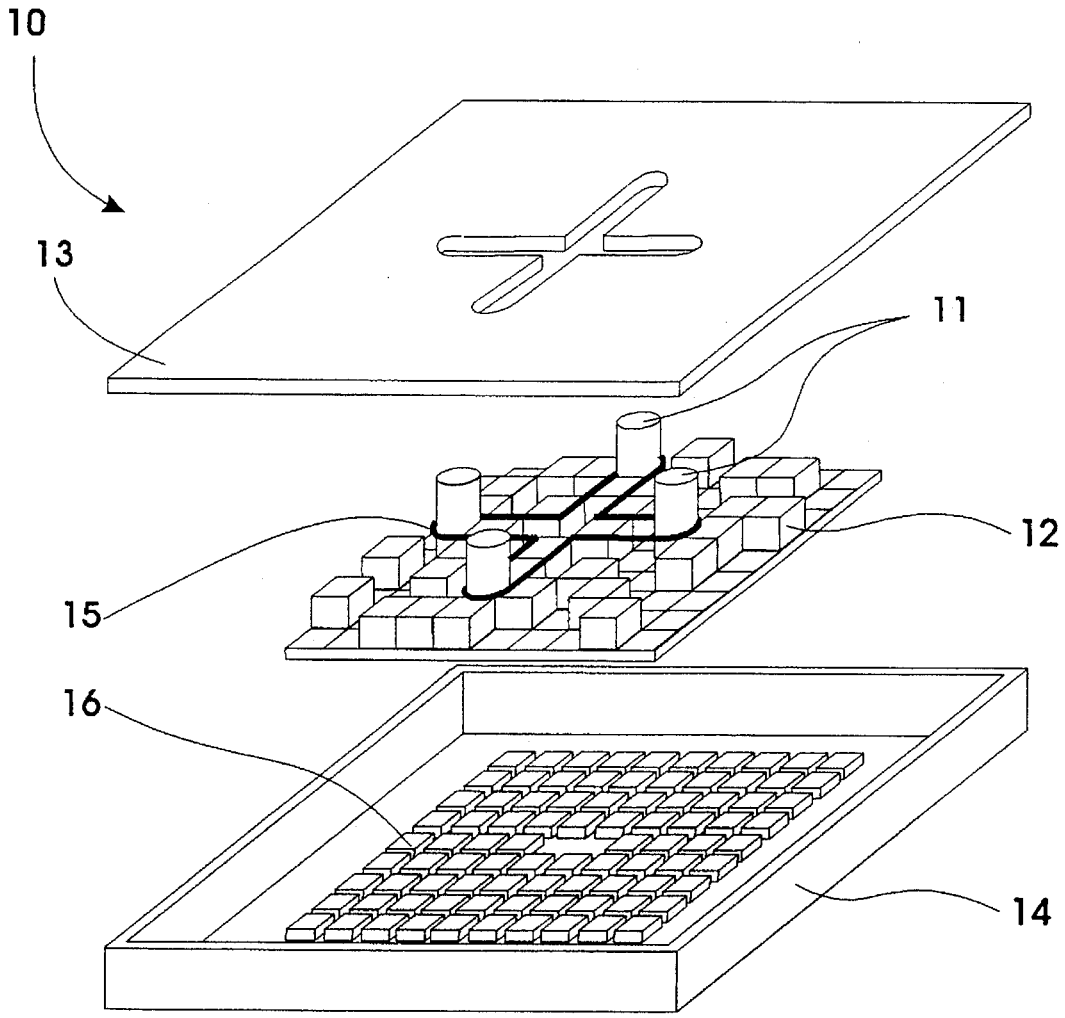
FIG. 2 shows an exploded view of the maze game shown in FIG. 1.
Figure 3A:
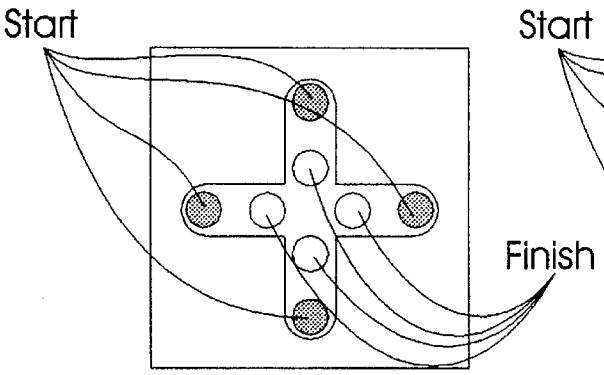
FIG. 3*a* shows an example of the start and finish positions of the maze pieces for the maze game shown in FIG. 1.
Figure 3B:
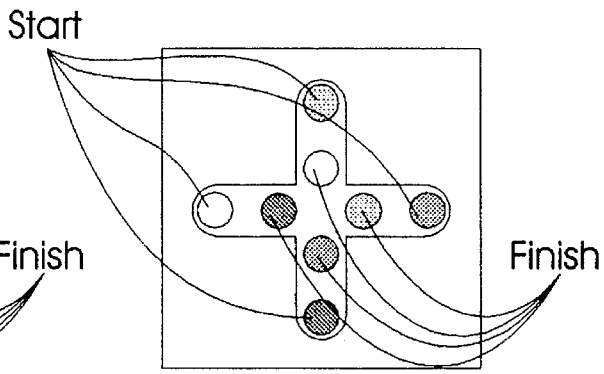
FIG. 3*b* shows an example of the alternate start and finish positions of the maze pieces for the maze game shown in FIG. 1.

Referring to the drawings, and, in particular to FIG. 1, a maze game 10 with multiple playing pieces constructed in accordance with various aspects of the invention is illustrated. In the illustrated embodiment, the maze game comprises four movable maze pieces 11, maze board 12 with passages dimensioned to receive pieces 11, top 13, having a slot dimensioned to receive pieces 11 therethrough, and housing 14. An exploded view of the maze game is shown in FIG. 2. Maze board 12 contains a flat surface and a convex pattern, forming passages to allow maze pieces 11 movements, conforming to said convex pattern. Top 13 prevents pieces 11 to be lifted off of the maze board and contains slot directing movements of pieces 11. The location of the slot in the assembled maze game is specified by a bold line 15. Housing 14, containing the maze board, comprises four walls and a bottom, in the assembled state being covered by top 13. Said bottom of the housing 14, includes a means 16, insuring board 12 movement in predetermined directions only, coinciding with directions of the slot of top 13, and preventing a skewed position of said board 12. When the maze game is used, pieces 11 occupy a predetermined starting position. The handler of the game moves one of pieces 11 in the direction allowed by the slot where this maze piece is contained. As a result of the move, the maze piece may either move along the passages of the maze board, or, if the direction of the slot doesn't coincide with the passage, move the maze board, if the location of other maze pieces allows such a movement. The object of the game is to place maze pieces 11 into a predetermined finish position. FIG. 3*a* shows the location of staff and finish positions of maze pieces 11. Maze pieces 11 and their start/finish positions may further include matching insignia, specifying a particular maze piece start and finish positions, as shown in FIG. 3*b*. Once the maze is solved and all pieces occupy finish positions the object of the game becomes to return pieces 11 to their initial start positions. Top 13 may be made either out of a transparent material to allow the game handler to see the maze board, or, to present a greater challenge, to be non-transparent or solid. In the latter case the handler of the game would have to recreate the pattern of the maze board in his/her mind by putting together parts of the pattern, visible through the slot in top 13.

Another object of the game is to move the maze board from one predetermined position in the housing 14 to another, i.e. from the upper left corner to the lower right corner of the housing, by manipulating maze pieces 11.

Figure 4:
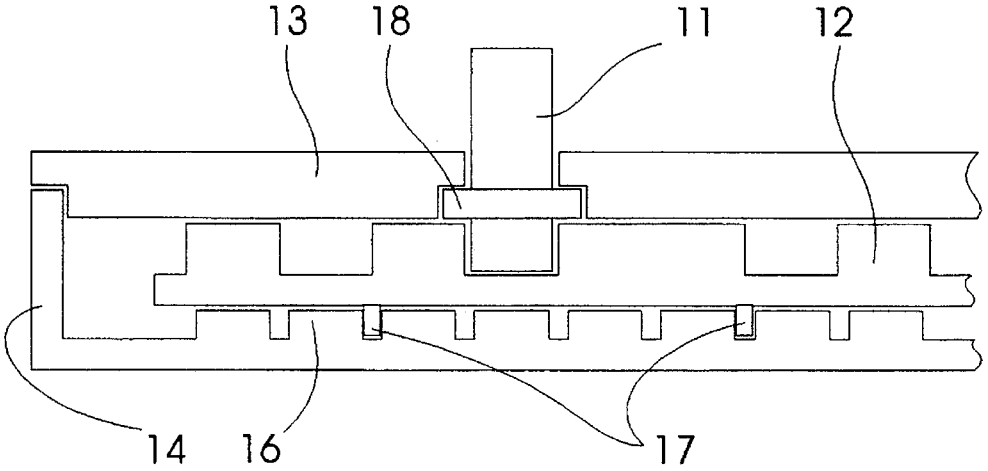
FIG. 4 shows a detailed internal structure of the maze game shown in FIG. 1.

The detailed construction of the maze game 10 is shown in FIG. 4. Maze piece 11 includes an expansion 18 attached as a means of prevention to lift piece 11 off of the maze board 12. Said board 12 has pegs 17 attached to the side opposite to the side, comprising a convex pattern. Said pegs, dimensioned to fit passages of the pattern 16, provide board 12 movement in predetermined directions only within the housing 14.

Figure 5:
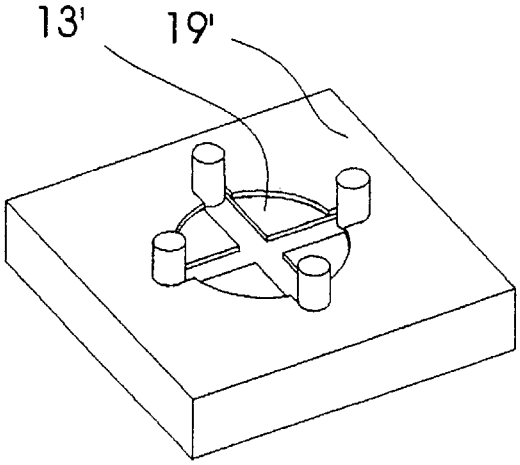
FIG. 5 shows an alternate embodiment of the maze game constructed in accordance with various aspects of the invention.

An alternate embodiment of the top of the maze game is illustrated in FIG. 5. In this embodiment the top comprises a transparent layer 13', providing maze pieces movements in predetermined directions and a solid layer 19' on top of layer 13', so as to cover a part of the maze board from the eyes of the handler of the puzzle and make a search for the solution more challenging.

Figure 6:
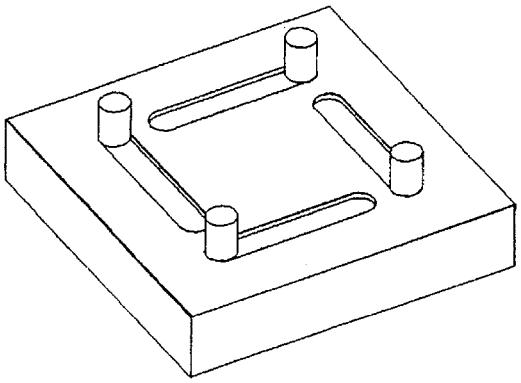
FIG. 6 shows another alternate embodiment of the maze game constructed in accordance with various aspects of the invention.

Another alternate embodiment of the top of the maze game is illustrated in FIG. 6. In this embodiment the orientation of the slots providing movement directions for the maze pieces has a different pattern.

Figure 7:
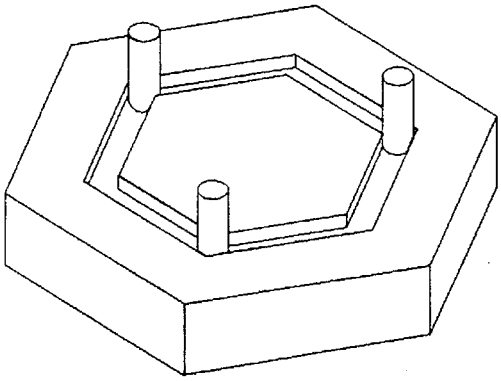
FIG. 7 shows an alternate embodiment of the maze game constructed in accordance with various aspects of the invention.

Yet another alternate embodiment of the maze game is illustrated in FIG. 7. In this embodiment the game has a general form of the hexagon and comprises three movable maze pieces.

Figure 7A:
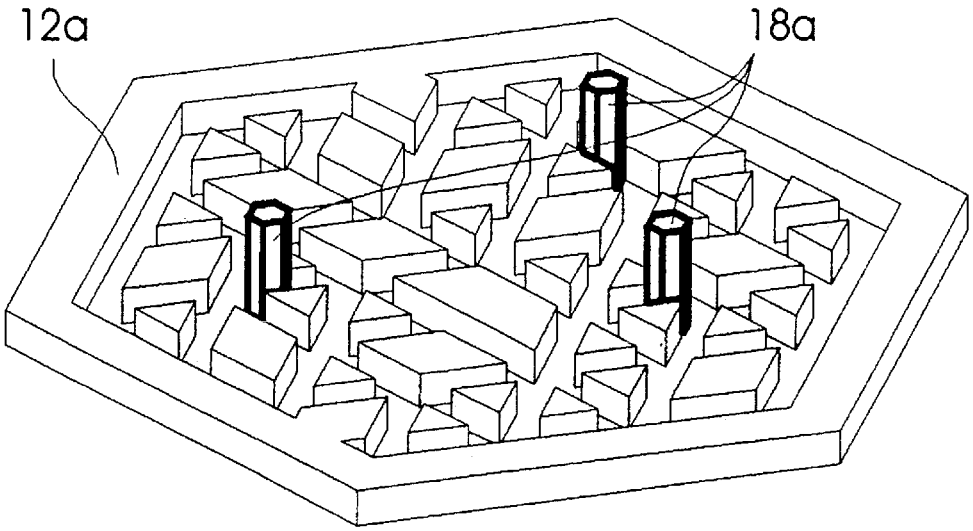
FIG. 7*a* shows an isometric view of the maze board for the maze game shown in FIG. 7.

FIG. 7*a* shows an embodiment of the maze board 12*a* with 3 maze pieces 18*a* for the maze game shown in FIG. 7.

Figure 7B:
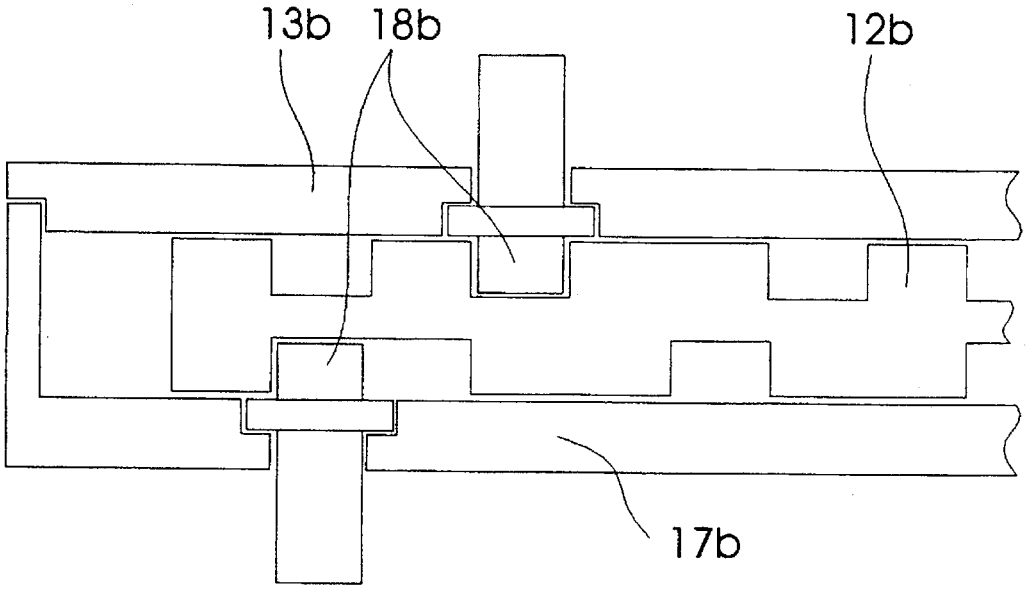
FIG. 7*b* shows an alternate embodiment of the maze game constructed in accordance with various aspects of the invention.

Another alternate embodiment of the maze game, FIG. 7*b*, further provides a bottom of the housing 17*b*, i.e. a side opposite to the top 13*b*, comprising slots to provide movement directions for the maze pieces 18*b*, wherein at least one of said maze pieces extends up and at least one of said maze pieces extends down from the maze board 12*b*. In the present description the meaning of "top" and "bottom" is interchangeable and relates to a specific orientation of the puzzle in the space. This embodiment further includes a double sided maze pattern of the maze board, wherein "bottom" maze pieces move in the "bottom" maze and "top" maze pieces move in the "top" maze of the maze board.

Although the specific patterns of the slots providing for movement directions for the maze pieces, the number of maze pieces and specific shape of the maze game are described, they can be varied in order to change the relative difficulty of the game.

Figure 8:
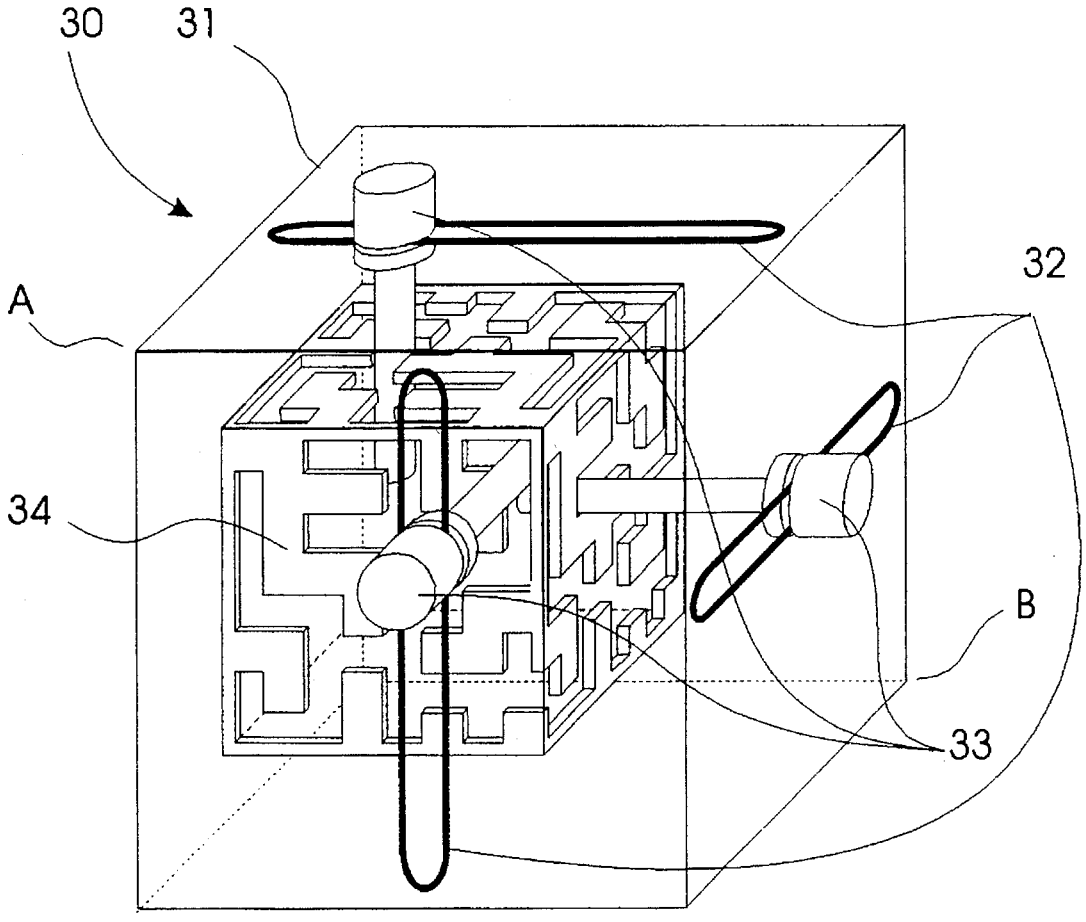
FIG. 8 shows yet another alternate embodiment of the maze game constructed in accordance with various aspects of the invention.

Another alternate embodiment of the top of the maze game 30 is illustrated in FIG. 8. In this embodiment, presenting essentially a three dimensional embodiment of the invention, the maze game provides a hollow transparent housing 31, some or all sides of said housing 31 including slots 32 providing for predetermined movement directions of the maze pieces 33. The invention further provides a maze body 34, positioned inside transparent housing 31. Said maze body 34 comprises sides with cut through passages, dimensioned to receive maze pieces 33 therethrough. As shown in FIG. 8 slots 32 are oriented in such a way so as to provide pieces 33 movements in three independent directions. Each maze piece 33 movement along its slot 32 causes either said maze piece respective movement along the passage of the maze unit 34, or, if the orientation of the passage doesn't coincide with the orientation of the slot 32, the movement of the piece 33 causes respective movement of maze body 34, if the location of other pieces 33 in other side mazes of the body 34 allow such movement. Maze pieces 33 have to be sufficiently long to remain inside the maze body 34 at all times. Maze pieces 33 further have to include means preventing them from being pulled out of the slots of transparent housing 31, or pushed inside said housing. FIG. 8 shows the maze pieces 33 with grooves which receive the slots 32 of the housing 31. The object of the maze game is to move maze pieces 33 from one predetermined position to another, as marked for each piece 33 in a respective side of the maze body 34. Another object of the game is to move cube 34 from one predetermined position to another, i.e. from the corner A to the corner B of the cube 31, as shown in FIG. 8, by manipulating maze pieces 33.

Only those sides of housing 31 that include slots, and respective sides of maze body 34 are necessary, for the maze game to operate properly. Those sides of the housing 31 that don't include slots (and respective sides of maze body 34) may be removed, making housing 31 and body 34 open objects. This embodiment of the present invention further allows housing 31 to be made out non-transparent material.

Although the specific orientation and the number of slots, the number of maze pieces and specific shape of the housing are described, they can be varied in order to change the relative difficulty of the game.

I claim:

1. A maze game with multiple game pieces comprising:

a polygonal housing, a maze board, including a flat surface with a convex pattern having passages of substantially identical width, located inside said housing, and further including means to provide the movement of said board inside the housing in predetermined directions only, a top, covering said housing and containing a plurality of cut through passages, or slots, a plurality of movable maze pieces of substantially elongated shape, located in said slots and extending inside the housing, to be received by said maze board passages, and outside, to be controlled by the maze game handler, said maze pieces further including means of prevention to be lifted off of the maze board;

the object of the maze game being to move said maze pieces from one predetermined position to another;

another object of the maze game being to achieve a predetermined relative orientation of maze pieces, yet another object of the maze game being to move the maze board from one predetermined position inside said housing to another, by manipulating maze pieces.

2. A maze game as defined in claim 1 wherein said housing has a rectangular shape.

3. A maze game as defined in claim 1 wherein said housing has a hexagonal shape.

4. A maze game as defined in claim 1 wherein the slot in said top has a shape of a cross.

5. A maze game as defined in claim 1 wherein the slot in said top has a polygonal shape.

6. A maze game as defined in claim 1 wherein said maze pieces further contain indicia, specifying individual maze piece start and finish positions.

7. A maze game as defined in claim 1 wherein said top is transparent.

8. A maze game as defined in claim 1 wherein said top is not transparent.

9. A maze game as defined in claim 1 wherein said top is composed of transparent and not transparent elements.

10. A maze game as defined in claim 1 wherein said game further includes a bottom, containing cut through passages, the maze board, containing a convex pattern with passages of substantially identical width both on top and bottom sides of said board, and wherein at least one movable maze piece is located in the top of the housing and at least one maze piece is located in the bottom of the housing.

11. A maze game with multiple game pieces comprising:

a three dimensional housing, sides of said housing containing cut through passages, or slots, a three dimensional maze body, sides of said body composed out of two dimensional mazes with cut through passages of substantially identical width, a plurality of movable maze pieces of substantially elongated shaped, located in said slots and extending inside the housing, to be received by said maze body passages, and outside to be controlled by the maze game handler, said maze pieces further including means for preventing the maze pieces from being pulled out or pushed into the housing, and providing the only allowed movement of said maze pieces to be along the slots in sides of said housing;

the object of the maze game being to move said maze pieces from one predetermined position to another;

another object of the maze game being to move the maze body from one predetermined position inside said housing to another, by manipulating maze pieces.

12. A maze game as defined in claim 11 wherein each side of said housing contains cut through passages.

13. A maze game as defined in claim 11 wherein some sides of said housing contains cut through passages.

14. A maze game as defined in claim 11 wherein said housing is made out of transparent material.

15. A maze game as defined in claim 11 wherein said housing is made out of non-transparent material.

* * * * *